US005662177A

United States Patent [19]

Bosma

[11] Patent Number: 5,662,177

[45] Date of Patent: Sep. 2, 1997

[54] TRIGGER MECHANISM FOR IMPACTING DEVICE

[76] Inventor: Marinus A. Bosma, 2234 Marina Park Dr., Fort Myers, Fla. 33905

[21] Appl. No.: 540,223

[22] Filed: Oct. 6, 1995

[51] Int. Cl.[6] ..... B25D 17/24

[52] U.S. Cl. ..... 173/202; 173/118; 173/210

[58] Field of Search ..... 173/202, 118, 173/122, 124, 210, 171

[56] References Cited

U.S. PATENT DOCUMENTS

| | | | |
|---|---|---|---|
| 3,358,778 | 12/1967 | Ferwerda | 173/202 |
| 3,358,779 | 12/1967 | Cunningham | 173/202 |
| 4,076,081 | 2/1978 | Schnell | 173/124 |
| 4,785,893 | 11/1988 | Kistner | 173/202 |
| 4,867,253 | 9/1989 | Eftefield et al. | 173/124 |

*Primary Examiner*—Scott A. Smith
*Assistant Examiner*—Jay A. Stelacone
*Attorney, Agent, or Firm*—William Weigl

[57] ABSTRACT

A device for breaking concrete and similar frangible materials to reduce it to rubble includes a power plunger and an actuator plunger mounted within a casing. The casing is carried on and operated by construction equipment such as a back hoe. As the back hoe is operated to cock the power plunger by moving the actuator plunger toward the concrete surface, a trigger mechanism affixed to the actuator plunger lifts the power plunger and an associated latch member to load a coil spring associated with the power plunger and presses against the latch member. As the coil is fully compressed, the trigger mechanism engages a trigger operating abutment and releases the latch member. The coil spring then fires the power plunger against the concrete. An improved trigger mechanism and latch member are provided with essentially spherical latching edge portions which compensate for misalignment of the power and actuator plungers due to wear of their bearings and the torsional effect of loading the coil spring, increasing the life of the parts and reducing the frequency of necessary repairs. The arrangement and shape of the latching edges are such that further coil spring compression is avoided when the latch member is released. In its preferred and simplist form, the trigger and latch members are produced from cast solid steel blocks welded to their respective plungers.

14 Claims, 3 Drawing Sheets

TRIGGER MECHANISM FOR IMPACTING DEVICE

This invention relates generally to a device for impacting the surface of a frangible material such as concrete in order to demolish and reduce it to rubble for removal and possibly replacement.

BACKGROUND OF THE INVENTION

Devices for accomplishing the above-stated objective are known, and are typically mounted on a boom-like member of a back hoe or other large earth equipment used in the construction industry. Examples of prior art relating to this invention are U.S. Pat. No. 4,785,893 issued to Kistner on Nov. 22, 1988 and U.S. Pat. No. 4,867,253 issued to Eftefield et al on Sep. 19, 1989.

Because of the very severe environment in which such devices are used, primarily in the demolition or breaking of concrete roads at the outset of a reconstruction program where abrasive particles and dust are flying in all directions, and because of the tremendous forces used in the concrete destruction, the impacting devices are normally subject to rapid wear, frequent servicing and parts replacement. The bearing surfaces supporting power and actuator plungers of the impacters require lubrication, but the lubrication itself can become a carrier for the grit and dust from the concrete, not only into the bearings, but oftentimes directly into the shielded housing or casing which support the plunger actuating mechanisms and a compression spring for firing the power plunger. Once bearing wear starts, it often progresses rapidly. The plungers are then subject to becoming misaligned relative to each other, causing uneven wear of the internal trigger mechanism as a result. Loading of the compression spring preparatory to firing the power plunger inherently tends to impart torsion to the power plunger, possibly causing internal scoring and galling of its casing as well as of the trigger mechanism. The more complicated the trigger and latching members are and the greater the number of movable parts, the greater the frequency of parts replacement due to the destructive abrasiveness of the materials in the environment and the tremendous forces to which the operating parts are subjected. Of necessity, the more frequently parts must be replaced, the greater the need to utilize removable fasteners to facilitate parts replacement. Nut and bolt type fasteners are more likely to break down faster than a weld, for example, from the constant high pounding they take during breaking concrete. Additionally, prior art trigger and latching mechanisms were subjected to severe forces in order to effect release, since the compression spring is preloaded to near its maximum at the time the trigger must go over center against the spring force to release the latch. The added force required to release the trigger and latching mechanism resulted in an increase in the rate of wear of the loaded parts.

SUMMARY OF THE INVENTION

A device for breaking concrete and similar frangible materials to reduce it to rubble includes a power plunger and an actuator plunger mounted within a housing or casing. The casing is carried on and operated by construction equipment such as a back hoe. As the back hoe is operated to cock the power plunger by moving the actuator plunger toward the concrete surface, a trigger mechanism affixed to the actuator plunger lifts the power plunger and an associated latch member to load a coil power spring which surrounds the power plunger and presses against the latch member. When the coil becomes loaded to near maximum compression, the trigger mechanism engages a trigger operating abutment and releases the latch member. The power spring then fires the power plunger against the concrete. An improved trigger mechanism and latch member are provided with spherical latching edge portions which compensate for axial misalignment of the power and actuator plungers due to wear of their bearings and inherent torsional effect of the coil spring, thus increasing the life of the parts and reducing the frequency of repairs. More appropriately, in the preferred embodiment, the latching edge portions are of a modified spherical shape. The arrangement and shape of the latching edges are such that additional coil spring compression is unnecessary to release the latch member, as was required in prior art mechanisms. In its preferred and simplist form, the trigger and latch members are produced from cast solid steel blocks welded to their respective plungers.

A principal object of the invention is to provide a novel triggering and latching means for a device of the type described.

An ancillary object is to provide such a means which results in reduced wear of the parts, due to accommodation of misalignment of the power and actuator plungers as wear of their bearings occurs.

Another object of the invention is to eliminate the inherent torsional effect on the power plunger of the coil spring, thereby preventing galling and scoring of the inside of the casing during spring compression.

Another object is to provide relatively large spherical or modified-spherical surface areas on a pair of cooperating latching edges, to accommodate plunger misalignment due to normal wear and tear resulting from operation.

A further object is to provide a trigger and latching mechanism which avoids the necessity of their being made to go over center to further compress the already-loaded coil spring at the time of latch release.

Still another object is to provide a trigger and latching mechanism in which the key operating elements are made of cast steel.

Further objects and advantages will become apparent from the following description, in which reference is made to the accompanying drawings.

DESCRIPTION OF THE PREFERRED EMBODIMENT

Figure 1:
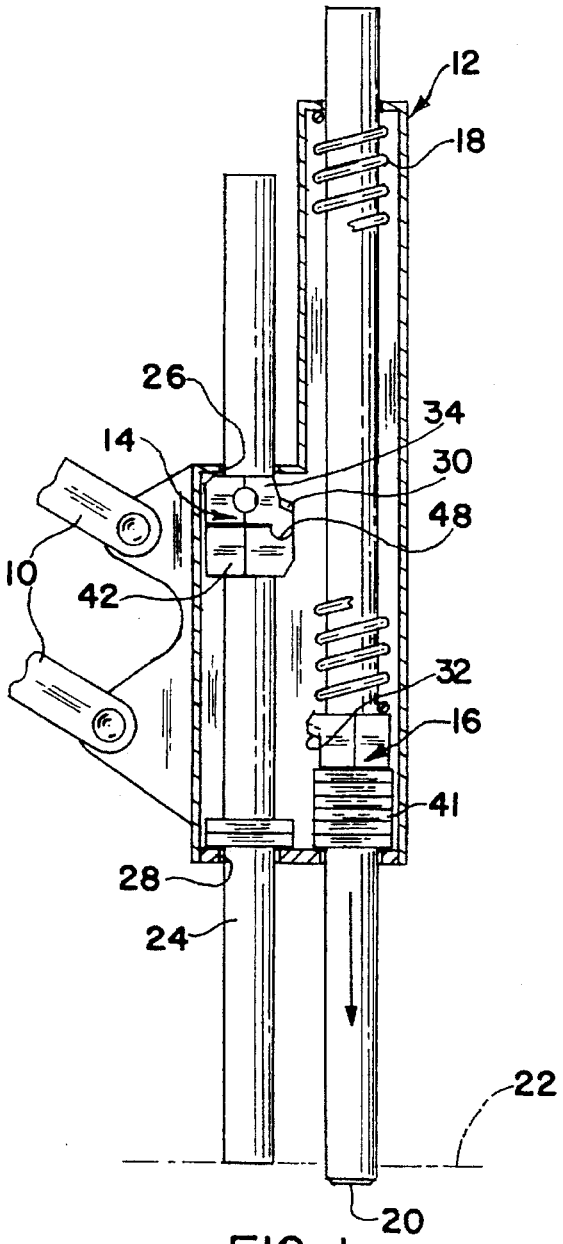
FIGS. 1 through 4 are sequential, fragmentary cross-sectional elevational views of the device mounted on a boom of a construction machine, illustrating the steps in which a power plunger which has just been fired is recocked and refired against the surface to be broken.
Figure 2:
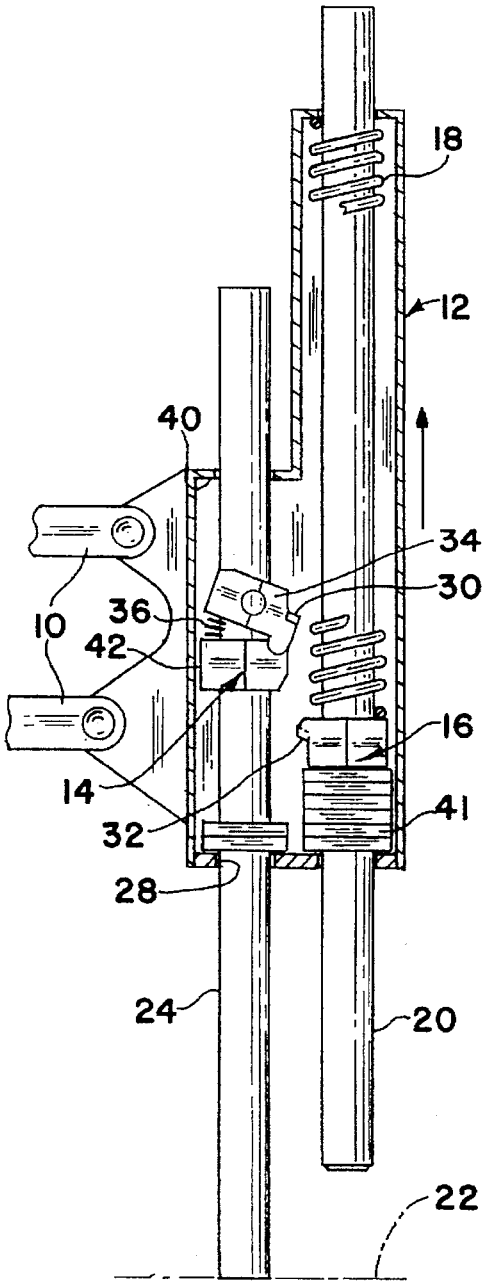
Figure 3:
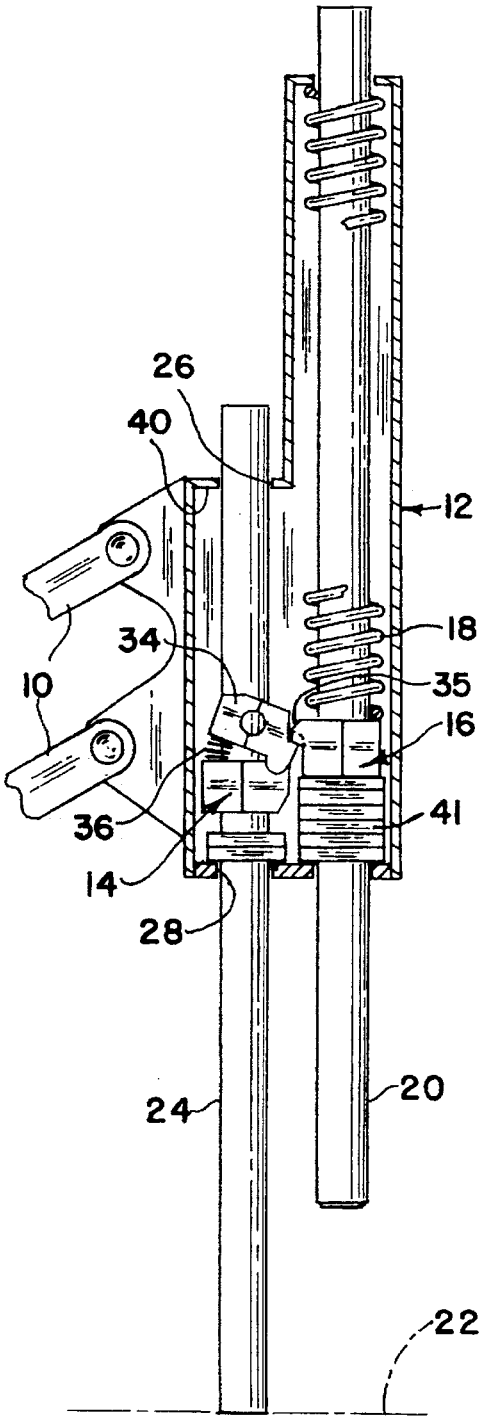

A general description of the manner in which the device functions is disclosed in FIGS. 1 through 4. A parallelogram linkage 10 of a boom-like structure of a back hoe or other piece of construction machinery is shown in FIG. 1, where a casing 12 is located in its lowermost position and the linkage 10 is pointing downwardly. This is a position in which a trigger mechanism 14 has just been actuated to release a latch member 16, allowing sudden expansion of a compression coil spring 18, resulting in firing of a solid steel power plunger 20 toward a surface 22 of concrete or other material to be reduced to rubble. Since the effects of a localized impact blow to concrete are well understood, it will not be described further herein, except to state that after each impact, the process is repeated. The blow can be likened to that of a sledge hammer striking and cracking concrete.

After the blow of FIG. 1 has been delivered, the linkage 10 is raised to commence another impacting cycle. This can be noted from the different angles of the linkage 10 and the changes in vertical height of the casing 12 with respect to the concrete surface 22. The weight of an actuator plunger 24, which is preferably tubular steel, is such that as the linkage 10 moves from the FIG. 1 toward the FIG. 2 and FIG. 3 positions, the plunger 24 slides through its bearings (not shown) mounted in openings 28 and 28, while maintaining contact of its lowermost end with the surface 22. As the casing 12 moves upwardly through the FIG. 2 position to the FIG. 3 position, the trigger mechanism 14 has an upwardly-facing latching edge portion 30 latch beneath a cooperating downwardly-facing latching edge portion 32 of the latch member 18. In order to accomplish this end, a trigger block 34 of the trigger mechanism 14 is pivotally mounted against the bias of compression springs 36 to the position of FIGS. 2–4. Just before the trigger block 34 arrives at the latching position of FIG. 3, contact of an edge of the block 34 with a sloping chamfer 35 on the latch member 16 compresses a pair of springs 36 in known fashion to pivot the block 34 counterclockwise until latching edge portion 30 snaps back and is captured beneath and in contact with latching edge portion 32. The casing 12 is then lowered as shown by the direction of arrow 38 in FIG. 4, to load the spring 18 for the next blow of the power plunger 20 to the surface 22. During the lowering, the natural tendency of compression of spring 18 is to apply torsion to latch member 16, but this is resisted in my design by the opposing self-aligning effect of contacting latching edge portions 30 and 32. No such self-aligning was present in similar prior art devices, and galling of the inside of the casing would occur. As a result, the present design requires only a one-eighth inch clearance between the latch member 16 and the internal side walls of the casing 12.

Figure 4:
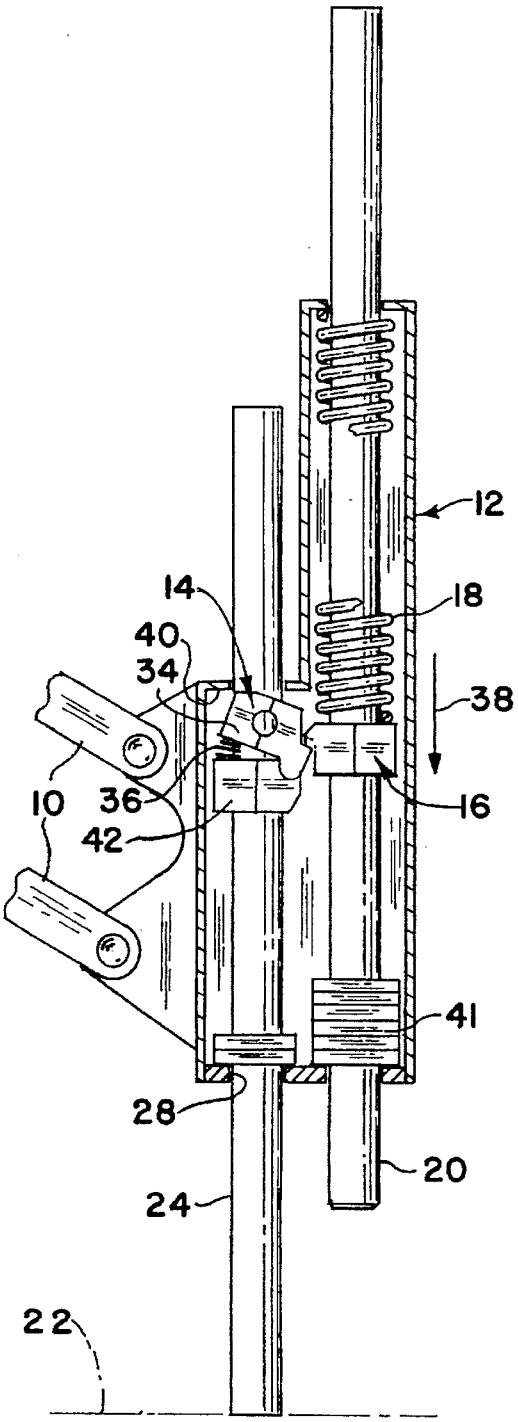

Coil spring 18 is almost compressed to its maximum at approximately the time the descending device reaches the FIG. 4 position. It will be noted that the trigger block 34 is still angled upwardly from compression springs 36. Immediately after this point, the trigger block 34 contacts the upper end of the casing adjacent opening 26. That upper end acts as an operating mechanism 40 to cause the springs 36 to be compressed and the latching edge portion 30 to move out of latching relation with latching edge portion 32. As unlatching occurs, the loaded coil spring 18 takes over and the power plunger 20 impacts the surface 22 to deliver the concrete another blow. The parts all assume their FIG. 1 positions again, and an impacting cycle has been completed. Shock absorbing rubber pads 41 may be utilized to protect the casing in the event the surface 22 does not absorb the entire blow.

What has been described thus far is generally known in the art from the aforesaid '893 and '283 patents. However, those structures are known to have serious wear and servicing problems because of their relative complexity and construction, and because they are required to further compress the already-loaded coil spring 18 as the latch is released. In addition, as wear of the trigger mechanism progressed, torsional loading of the latch member enabled rotation of the power plunger. This rotation eventually resulted in the latch member galling the casing internally.

Figure 5:
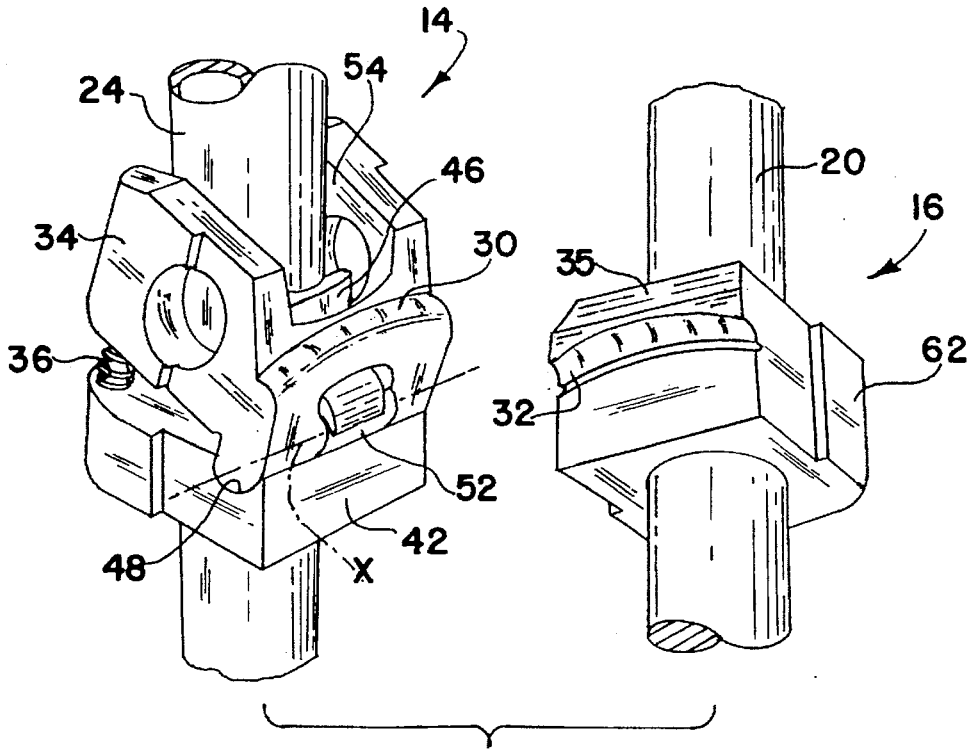
FIG. 5 is a fragmentary exploded isometric view of the triggering mechanism and latch member of the preferred form of the invention.

FIG. 5 is a composite isometric view of the cooperating trigger mechanism 14 and latch member 16. The mechanism 14 includes a solid steel trigger-journaling block 42 which is preferably welded to the actuator plunger 24. For ease of manufacture as well as simplicity, all of the blocks of this invention are preferably made from castings, enabling all complex surfaces to be computer-generated in the mold patterns themselves, rather than machine them separately on the individual parts. Atop the block 42 is the trigger block 34 which is retained in contact therewith by a retaining member 48. The trigger-journaling block 42 is provided with a semi-cylindrical recess 48 and the lower end of the retainer member 46 is similarly recessed as at 50. Together, the recesses 48 and 50 capture a cylindrical journal 52, making the block 34 pivotable about the axes of the journal 52 and recesses 48 and 50. The trigger block 34 is normally urged clockwise and angularly upwardly toward the right as viewed in FIG. 6 as the result of bias of the springs 36. In the instance where the actuator plunger is cylindrical as shown, rightward movement is limited by one end of the elliptical shape of an elongated opening 54 which causes the left end 58 of the opening 54 to contact the actuator plunger 24. The retaining member 46 is preferably provided with a concave surface adjacent the plunger 24 to facilitate good welding contact therewith. In effect, the trigger block 34 is trapped to follow the trigger-journaling block 42 at all times.

Figure 6:
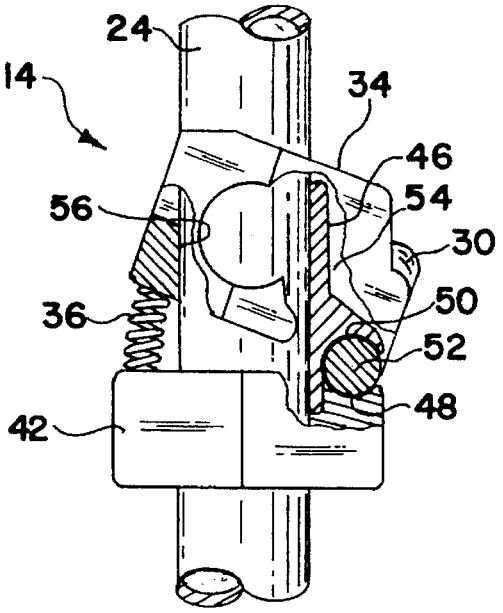
FIG. 6 is an elevational view of the triggering mechanism with parts broken away for clarity.
Figure 7:
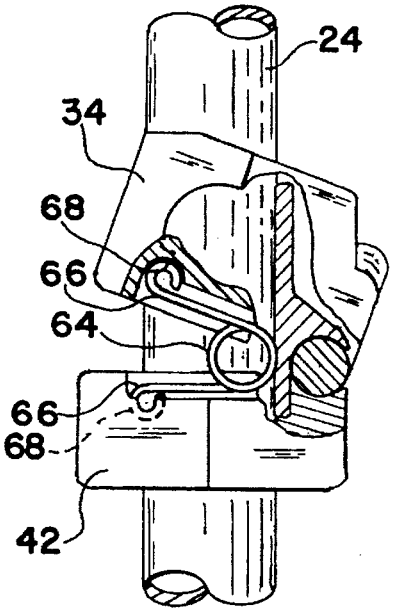
FIG. 7 is a view similar to FIG. 6 showing a modified spring arrangement between the members of the triggering mechanism.

FIG. 7 is a view similar to that of FIG. 6 illustrating a modification in which a pair of torsion springs 64 at opposite sides of the blocks 34 and 42 replace the compression springs 36 of the FIG. 6 version. The springs 64 have their ends 66 formed to be captured in pockets 68 cast in each side of each block 34 and 42. The torsion springs are easier to install and to replace if necessary, and are less subject to wear than the compression springs 36.

As shown best in FIG. 5, the trigger block 34 has the convex latching edge portion 30 formed about a radius on the order of eight inches. However, the center or axis (represented by the dot-dash line "x") about which the trigger block 34 pivots, is only two and one-half inches at the opposite sides of block 34 and is three and one-eight of an inch at the center or high point of latching edge portion 30. In effect, axis x represents a chordal line across the larger eight-inch radius which forms the curvature of the edge portion 30. The portion 30 may thus be said to have a modified-spherical configuration with its largest radius along axis x being in the middle, tapering toward a smaller radius at each of its ends. If the axis x were at the eight inch center, the surface of latching edge portion 30 would be truly spherical. A similar mating concave modified-spherical latching edge portion 32 is provided on the underside of a latch block 62. Block 62 is the sole element of the latch member 16. The latch block 62 is cast solid steel to add maximum weight to the power plunger 20 and is preferably welded to the power plunger 20 to minimize any impacting effects on the structure, such as might occur if removable fasteners were to be used. By producing latch block 62 from a casting, the modified-spherical configuration of edge portion 32 can be controlled in the mold pattern and need not be specially machined on each block produced.

It can be seen that any tendency toward plunger torsional and wear misalignment will be compensated for because of the shape of the latching edge portions 30 and 32, independently of whether the plungers are misaligned and out of parallel in any specific direction. The latching edge portions thus effectively become a universal joint which is lubricated with an appropriate grease. Additionally, the modified-spherical latching edges make for a freer release of the latching device, since its tendency will be for the surfaces to smoothly slide apart during unlatching without any compression of spring 18, rather than pass over a sharp edge, which requires further compression of spring 18 at a time when it is already loaded to near maximum compression. It can be noted, for example, that there is essentially point contact of the latching edges in the aforementioned '253 and '893 patents, whereas the large spherical surface areas of the edge portions 58 and 60 provide for reduced and more even surface wear. Even though dirt and dust may eventually enter the casing 12 and come in contact with the components described herein, those components will be less subject to wear because of their rugged construction, simplicity and large latching edge area. Closable access openings (not shown) may be provided in the casing to enable the various blocks to be cleaned and/or lubricated, as required.

Various changes may be made in the details of construction without departing from the spirit and scope of the claims. For example, the actuator plunger may be dispensed with and supplanted by a hydraulic or other moving device for operating the trigger mechanism between its latching and latch-releasing positions. Also, while solid steel blocks are preferred for long life and minimization of operating parts, their fabrication is a possibility for smaller units where the loading is not as severe or where the material to be demolished is not as abrasive as concrete.

Having described my invention, I claim:

1. A device for impacting the surface of a frangible material with a sudden, concentrated high force in order to demolish said material, said device including an elongated casing; an elongated power plunger in said casing, said power plunger being reciprocable lengthwise of and having opposing ends extending outwardly through openings in opposing ends of said casing; an elongated actuator plunger in closely-spaced lateral and parallel relationship to said power plunger and being reciprocable lengthwise of and having opposing ends extending outwardly through openings in said opposing ends of said casing; guiding means in the ends of said casing maintaining said actuator and power plungers essentially in said parallel relationship along their respective axes; a latch member affixed to said power plunger between its ends within said casing; a coil compression spring associated with said power plunger and extending between said latch member and an abutting surface at the end of said casing remote from the surface to be demolished; a trigger mechanism mounted on said actuator plunger, said trigger mechanism being movable with said actuator plunger relative to the opposing ends of said casing between a first position nearest said material, for engaging and latching with said latch member when said coil spring is fully extended and a second position remote from said material in which said latch member is moved toward the opposite end of said casing to compress said spring and cock aid power plunger for sudden, impacting movement toward said surface upon release of said latch member by said rigger mechanism; and means affixed to said casing for operating said trigger mechanism to release said latch member after said coil spring has been compressed, said release enabling said power plunger to be fired rapidly toward said surface as said spring expands; the improvement comprising:

said trigger mechanism including:

i) a trigger-journaling block affixed to said actuator plunger;

ii) a trigger block pivotally supported on said trigger-journaling block;

iii) means for pivoting said trigger block about an axis perpendicular to said actuator plunger on a side of said trigger-journaling block adjacent said power plunger, said pivoting means comprising a semi-cylindrical recess in said trigger-journaling block and a semi-cylindrical journal on said trigger block corresponding to said recess and seated therein;

iv) spring means biasing a side of said trigger block remote from said pivoting means away from said trigger-journaling block; and v) means retaining said trigger block journal in intimate contact with said recess and functioning in conjunction with said spring means to normally position said trigger block angularly in a latching position relative to said trigger-journaling block;

said trigger block having a convex essentially spherical latching edge portion adjacent said pivoting means and facing said latch member in interfering relationship therewith; and, said latch member including:

i) a latch block having a concave essentially spherical edge portion facing and corresponding essentially to the convex spherical portion of said trigger block, said edge portions being adapted to interfere and latchingly engage while said trigger mechanism moves said latch block between said first and second positions of said trigger mechanism, and said trigger block being adapted to pivot in said recess in response to actuation of said spring means by said trigger mechanism operating means, to release said trigger block edge portion from interfering contact with said latch block edge portion and thereby cause said power plunger to be fired toward said material by said coil spring.

2. The device according to claim 1 wherein said power plunger is steel and said latch block is solid steel welded to said power plunger.

3. The device according to claim 1 wherein said latch block and trigger-journaling block are solid steel welded respectively to said power plunger and said actuator plunger, and wherein said trigger block is essentially solid steel with an opening therethrough to fit over and enable pivoting about said actuator plunger between its angular latching position and a latch-releasing position.

4. The device according to claim 3 wherein said journal comprises a cylindrical portion between its ends and wherein said retaining means has a semi-cylindrical recessed bearing surface in contact with said cylindrical portion, said retaining means being affixed to said actuator plunger.

5. The device according to claim 4 wherein said retaining means is solid steel and is affixed to said actuator plunger by welding.

6. A device for impacting the surface of a frangible material with a sudden, concentrated high force in order to demolish said material, said device including an elongated casing; an elongated power plunger in said casing, said power plunger being reciprocable lengthwise of and having opposing ends extending outwardly through openings in opposing ends of said casing; an actuator means in closely-spaced lateral operating relationship to said power plunger; guiding means in the ends of said casing maintaining said power plunger for movement along its axis; a latch member affixed to said power plunger between its ends within said casing; a coil compression spring associated with said power plunger and extending between said latch member and an abutting surface at the end of said casing remote from the surface to be demolished; a trigger mechanism mounted on said actuator means, said trigger mechanism being movable with said actuator means relative to the opposing ends of said casing between a first position nearest said material, for engaging and latching with said latch member when said coil spring is fully extended and a second position remote from said material in which said latch member is moved toward the opposite end of said casing to compress said spring and cock said power plunger for sudden, impacting movement toward said surface upon release of said latch member by said trigger mechanism; and means for operating said trigger mechanism to release said latch member after said coil spring has been compressed, said release enabling said power plunger to be fired rapidly toward said surface as said spring expands; the improvement comprising:

said trigger mechanism including:

i) a trigger-journaling member carried by said actuator means;

ii) a trigger pivotally supported on said trigger-journaling member;

iii) means for pivoting said trigger about an axis perpendicular to said actuator means on a side of said trigger-journaling member adjacent said power plunger, said pivoting means comprising a semi-cylindrical recess and a semi-cylindrical journal, one of which is on said trigger-journaling member and the other of which is on said trigger;

iv) at least one second spring biasing said trigger toward said latch member; and v) means retaining said journal in intimate contact with said recess and functioning in conjunction with said at least one second spring to normally position said trigger in a latch member latching position relative to said trigger-journaling block;

said trigger having a convex essentially spherical latching edge portion adjacent said pivoting means and facing said latch member in interfering relationship therewith; and, said latch member including:

i) a concave essentially spherical edge portion facing and corresponding essentially to the convex spherical portion of said trigger, said edge portions being adapted to interfere and latchingly engage while said trigger mechanism moves said latch member between said first and second positions of said trigger mechanism, and said trigger being adapted to pivot in said circular recess in response to actuation of said second spring by said trigger mechanism operating means, to release said trigger edge portion from interfering contact with said latch member edge portion and thereby cause said power plunger to be fired toward said material by said coil spring.

7. The device according to claim 6 wherein said trigger comprises a portion of a cast solid trigger block, and wherein said at least one second spring comprises a pair of torsion springs on opposite sides of said trigger-journaling block and said trigger block.

8. The device according to claim 6 wherein said actuator means comprises a plunger which extends through opposite ends of said casing and is moved lengthwise therethrough to move said trigger mechanism between its first and second positions, and wherein said trigger operating mechanism is affixed to said casing adjacent an end thereof remote from the material being impacted.

9. The device according to claim 6 wherein said semi-cylindrical recess is in said trigger-journaling member and said semi cylindrical journal is on said trigger.

10. A device for impacting the surface of a frangible material with a sudden, concentrated high force in order to demolish said material, said device including an elongated casing; an elongated power plunger in said casing, said power plunger being reciprocable lengthwise of and having opposing ends extending outwardly through openings in opposing ends of said casing; an actuator means in closely-spaced lateral operating relationship to said power plunger; guiding means in the ends of said casing maintaining said power plunger for movement along its axis; a releasable latch member affixed to said power plunger between its ends within said casing; a first spring means associated with said power plunger, said spring means being loadable against a normal biasing direction for driving said power plunger against the material upon release of said latch member; a trigger mechanism mounted on said actuator means, said trigger mechanism being movable with said actuator means relative to the opposing ends of said casing between a first position nearest said material, for engaging and latching with said latch member while said first spring means is being loaded and a second position remote from said material in which said latch member is moved toward the opposite end of said casing to load said first spring means and cock said power plunger for sudden, impacting movement toward said surface upon release of said latch member by said trigger mechanism; and means for operating said trigger mechanism to release said latch member after said first spring means has been loaded, said release enabling said power plunger to be fired rapidly toward said surface by said first spring means; the improvement comprising:

said trigger mechanism including:

i) a trigger-journaling member carried by said actuator means;

ii) a trigger pivotally supported on said trigger-journaling member;

iii) means for pivoting said trigger about an axis perpendicular to said actuator means on a side of said trigger-journaling member adjacent said power plunger, said pivoting means comprising a semi-cylindrical recess and a semi-cylindrical journal, one of which is on said trigger-journaling member and the other of which is on said trigger;

iv) second spring means biasing said trigger toward said latch member; and v) means retaining said journal and recess in intimate contact and functioning in conjunction with said second spring means to normally position said trigger in a latch member latching position relative to said trigger-journaling block;

said trigger having a convex, essentially spherical latching edge portion adjacent said pivoting means and facing said latch member in interfering relationship therewith; and, said latch member including:

i) a concave, essentially spherical edge portion facing and corresponding essentially to the convex spherical portion of said trigger, said edge portions being adapted to interfere and latchingly engage while said trigger mechanism moves said latch member between said first and second positions of said trigger mechanism, and said trigger being adapted to pivot in said circular recess in response to actuation of said second spring means by said trigger mechanism operating means against its normal biasing direction, to release said trigger edge portion from interfering contact with said latch member edge portion and thereby cause said power plunger to be fired toward said material by said first spring means.

11. The device according to claim 10 wherein said trigger comprises a portion of a cast solid trigger block, and wherein said second spring means comprises a pair of torsion springs on opposite sides of said trigger-journaling block and said trigger block.

12. The device according to claim 10 wherein said actuator means comprises a plunger which extends through opposite ends of said casing and is moved lengthwise therethrough to move said trigger mechanism between its first and second positions, and wherein said trigger operating mechanism is affixed to said casing adjacent an end thereof remote from the material being impacted.

13. The device according to claim 10 wherein said semi-cylindrical recess is in said trigger-journaling member and said semi-cylindrical journal is on said trigger.

14. The device according to claim 10 wherein said first spring means comprises a coil compression spring.

* * * * *